United States Patent [19]

Wrightson

[11] Patent Number: 4,460,394

[45] Date of Patent: Jul. 17, 1984

[54] EVAPORATIVE COOLER PAD ASSEMBLY

[76] Inventor: Robert W. Wrightson, 3 Rothesay Ave., St. Marys, South Australia, Australia

[21] Appl. No.: 388,111

[22] Filed: Jun. 14, 1982

[30] Foreign Application Priority Data

Jun. 19, 1981 [AU] Australia ..... PE9364

[51] Int. Cl.[3] ..... B01D 46/10

[52] U.S. Cl. ..... 55/491; 55/492; 55/503; 55/DIG. 31; 261/DIG. 41

[58] Field of Search ..... 55/491, 492, 503, 517, 55/519, DIG. 31; 261/106, DIG. 41

[56] References Cited

U.S. PATENT DOCUMENTS

| | | | |
|---|---|---|---|
| 2,614,654 | 10/1952 | Strinden | 55/503 |
| 2,637,540 | 5/1953 | Rowe | 261/DIG. 41 |
| 3,019,854 | 2/1962 | O'Bryant | 55/491 |
| 3,284,068 | 11/1966 | Goettl | 261/106 |
| 3,768,233 | 10/1973 | Mateson | 55/DIG. 31 |
| 3,902,877 | 9/1975 | Swaim | 422/123 |

*Primary Examiner*—David L. Lacey

*Attorney, Agent, or Firm*—Jay L. Chaskin

[57] ABSTRACT

An evaporative cooler pad assembly comprising a pad of absorbent material, e.g. woodwool is retained between a pair of side grids each of which has projections which interengage the other, and at least some of the projections extend through the pad and support it.

3 Claims, 4 Drawing Figures

EVAPORATIVE COOLER PAD ASSEMBLY

This invention relates to an evaporative cooler pad assembly which is useful for directing flow of water over absorbent material while air is also drawn through the absorbent material to thereby effect evaporation with its accompanying loss of sensible heat (and consequential gain of latent heat).

BACKGROUND OF THE INVENTION

In evaporative coolers it is usual to employ a pad of woodwool or other absorbent material over which water passes under the effects of gravity, while a fan draws air through the pad, the air then being in very intimate contact with quite large wetted surface areas of the woodwool, and evaporating at that stage. The fan blows the air with its lower sensible heat but higher latent heat into a space which requires cooling. This invention is particularly suitable for use in a hot, dry climate.

A number of problems have been encountered with evaporative coolers as presently used, and one of these is a tendency for the woodwool to deteriorate and become brittle and at the same time to sag. An object of this invention is to provide a cooler pad with means which will reduce the sagging of the absorbent material.

BRIEF SUMMARY OF THE INVENTION

In this invention a pad of absorbent material, e.g. woodwool, is retained between a pair of side grids each of which has projections which interengage the other, and at least some of the projections extend through the pad and support it.

Another problem which has been encountered heretofore has been the difficulty of removing a woodwool pad for cleaning purposes. When in frequent use, the woodwool (or other absorbent material) has its surface contaminated due to continued evaporation of water therefrom, and cleaning is quite often desirable. However, the facilities for removal of a pad have been somewhat inadequate in the past and another object of this invention is to provide a pad which is easily removed or replaced.

In the past woodwool pads have frequently been constructed to include a wire mesh retaining grid, but this is not only slow to assemble, but when assembled results in a product having poor mechanical characteristics so that a pad can for example be very easily changed in shape and thereby become less effective, and another object of this invention is to provide a pad wherein the woodwool or other absorbent material is retained more positively than heretofore, and further to provide a pad wherein the retaining means comprise a pair of spaced mouldings which interengage one another.

In one embodiment of the invention an evaporative cooler pad assembly is provided with a pair of side grids, each being a moulding of polymeric material, each having both projecting spikes and retaining membranes, the spikes of one moulding engaging the retaining membrane of the other moulding, the spikes extending through the absorbent material and retaining the material as a unified pad unlikely to be subject to sagging or other dimensional distortions.

In an embodiment of the invention, with the object of having a single design of moulding, each moulding is reversible on the pad so that the spikes of one moulding engage part conical membranes or other retaining members of an identical moulding. This reduces tooling costs in production.

In a further embodiment of the invention, there are provided means whereby the pad is more easily withdrawn for cleaning than prior art pads, in that each moulding is provided with a row of guide tabs and a guide bar extending along at least one edge, such that the pad as a whole may be located over the edge of a flange of a supporting case.

BRIEF DESCRIPTION OF THE DRAWINGS

An embodiment of the invention is described hereunder in some detail with reference to and is illustrated in the accompanying drawings, in which.

Figure 1:
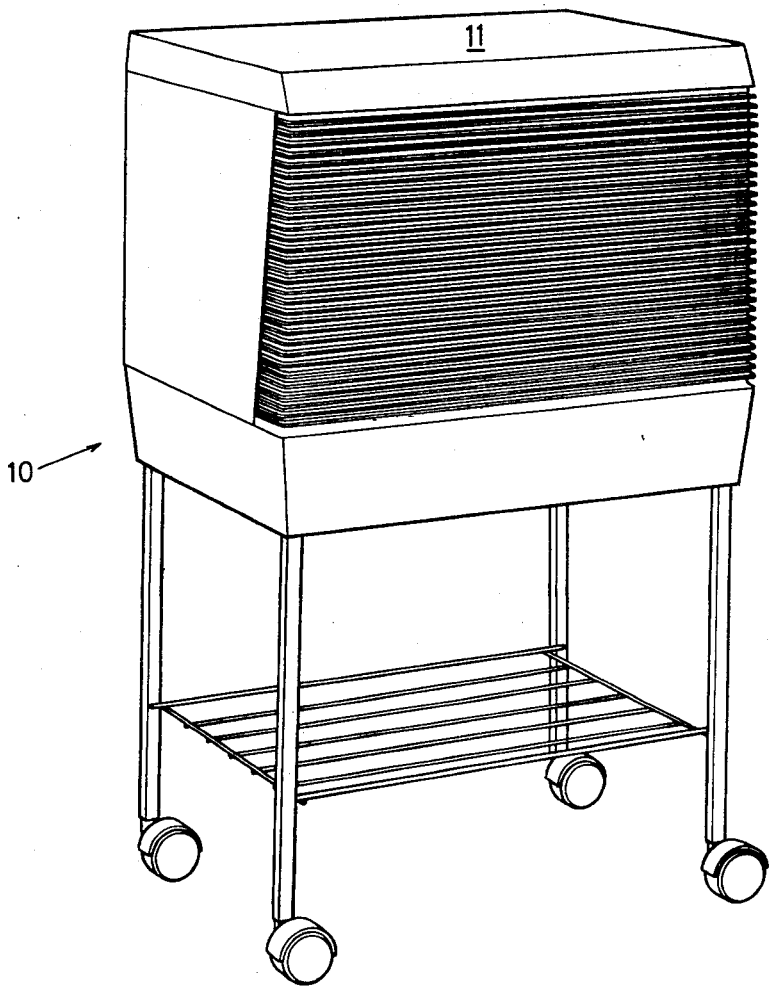
FIG. 1 is a perspective view of a cooler.
Figure 2:
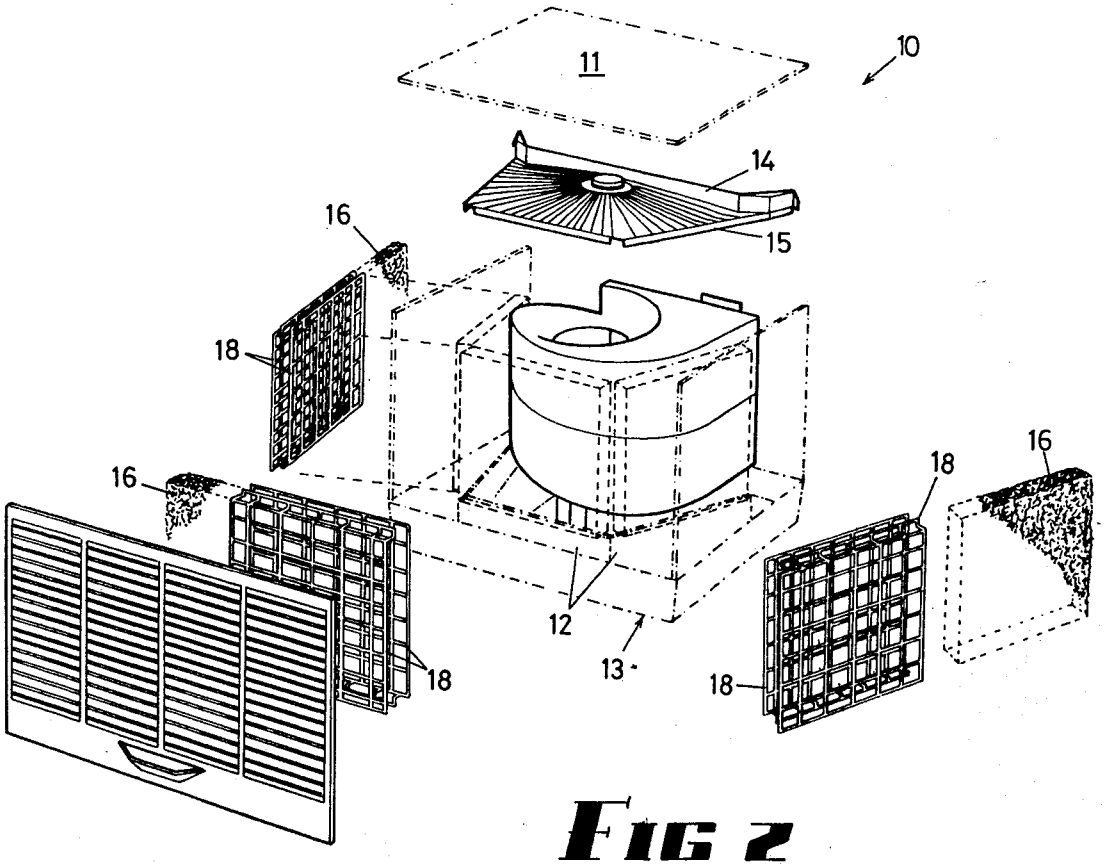
FIG. 2 is an "exploded" perspective view of the cooler.

In this embodiment an evaporative cooler 10 comprises a cabinet 11 which contains three flanges 12 upstanding from its base 13, and a spreader 14 having depending flanges 15, and there are three identical pads 16 of absorbent material, one of which extends part way across the rear of an evaporative cooler body and the other two of which form forwardly diverging wings, and a cooler fan 17 is located on the concave side of the assembly.

Each cooler pad 16 is a pad of woodwool which is retained between a pair of grids 18, being mouldings of polymeric material. Each grid moulding 18 of polymeric material comprises a plurality of relatively long spikes 20 outstanding from one side, each outstanding spike 20 having a diameter which decreases towards its point, and the point terminates in a barbed end 21, or arrow head. Each moulding also is provided with a plurality of part conical membranes 22, each part conical membrane being surrounded by a boss 23, and has a central aperture which is penetrated by the barbed end of a spike of an identical moulding when turned face to face by inverting and reversing one moulding with respect to the other.

Each moulding has side walls formed from parallel bars at right angles to one another which constitute a grid which retains the woodwool pad 16 from lateral displacement, while the spikes retain woodwool from vertical displacement.

Figure 4:
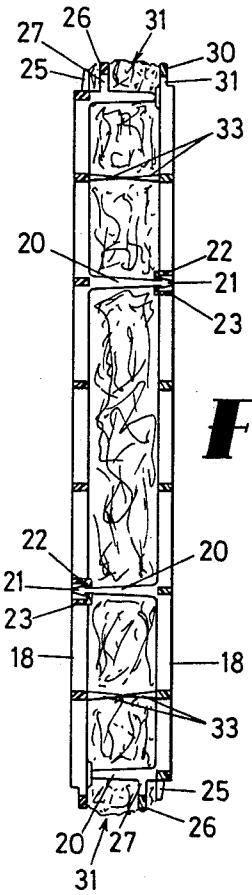
FIG. 4 is a section on line 4—4 of FIG. 3.
Figure 3:
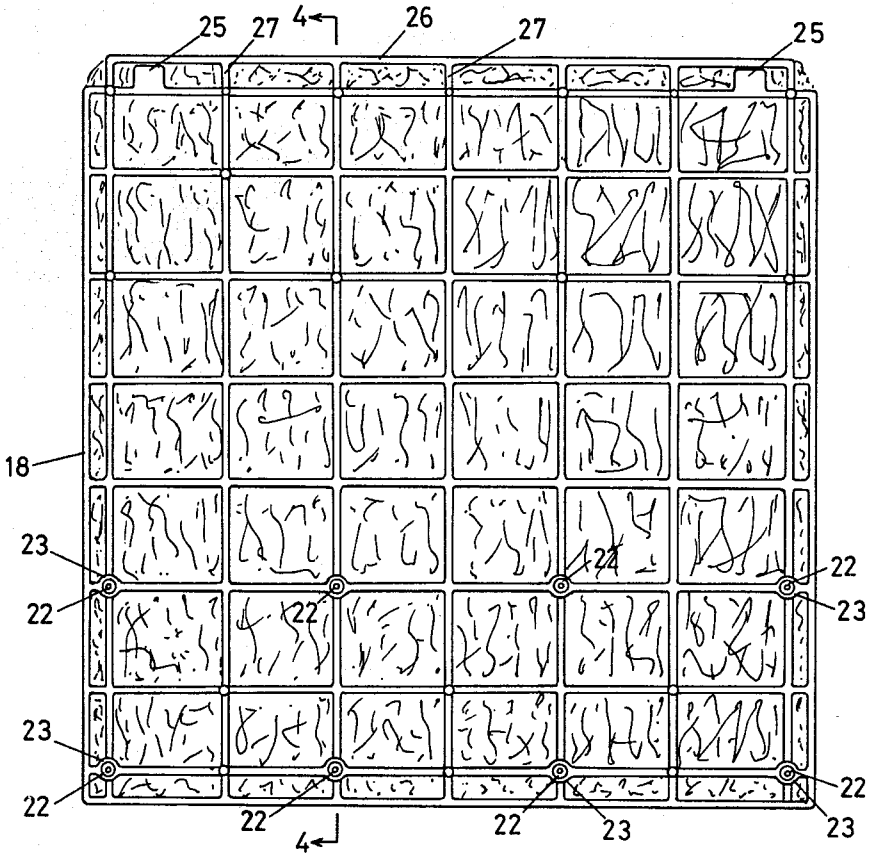
FIG. 3 is a side elevation of a cooler pad assembly.

Each moulding is also provided along one edge (which in one case is the top and in the other, the bottom edge) with a row of guide tabs 25 extending outwardly and spaced from a guide bar 26 which is carried on short stub posts 27 outstanding from the grid, and defining with the guide tabs a guide slot in end elevation (FIG. 4) such that the moulding may be positioned over edges of flanges 12 and 15 in the cabinet and moved into position with a sliding action. A second bar 30 is a retaining bar which co-operates with the said guide bar of the other grid to compress the edge of the absorbent pad at 31. The compressed edges offer resistance to air flow, which is therefore encouraged to extend through the main area of the pad, and this arrangement provides an effective "seal" against air flow extending around the edges of the pad, a difficulty not heretofore solved.

In addition to the relatively long spikes 20 which have been described above having the barbed ends which engage the part conical membranes to retain the two mouldings together, the mouldings are also provided with a plurality of relatively short spikes 33 also of conical shape, the spikes of one moulding being coaxial with corresponding spikes of the other moulding and extending nearly to the medial plane between the two mouldings. This further assists in retaining the woodwool together.

Since the spikes retain the woodwool as a non-sagging mass, they further assist in inhibiting the edges of the evaporative cooler pad from having the woodwool displaced such that a low resistance path is offered to the flow of air, and consequently the sealing which can be achieved with this cooler pad around the edges is much more efficient and effective than the sealing which can be achieved with prior art cooling pads made by alternative methods. The upper edge of each pad is contained by flanges 15 of the spreader which spreads water to flow downwardly over the outer surface of the pad, and as the water flows downwardly, the air flow draws it inwardly over the absorbent woodwool. This then reduces the amount of water which might otherwise enter the air stream in droplet form and thereby be objectionable to a user.

Various modifications in structure and/or function may be made to the disclosed embodiments by one skilled in the art without departing from the scope of the invention as defined by the claims.

What is claimed is:

1. An evaporative cooler pad assembly comprising a pad of absorbent material and a pair of side grids, each said grid being a moulding of polymeric material and having a plurality of projections interengaging the other said grid, at least some of said projections extending through said pad and thereby supporting said pad, each said grid being of identical size and shape, one being inverted and reversed in direction with respect to the other, each said projection of each said grid being a spike, and each of at least some of said projections has a barbed end which engages a membrane in the other of said grids and resists release and wherein one edge of each of said grids has a row of tabs extending therefrom, and a row of stub posts also extending therefrom and supporting a guide bar spaced from the tabs to define a slot in end elevation, the other end also having a plurality of stub posts extending therefrom and supporting a retaining bar which is spaced from the guide bar of the other said grid and defines therewith a retaining space which retains and compresses the pad of absorbent material.

2. An evaporative cooler pad assembly according to claim 1 wherein each said membrane is part conical in shape and is surrounded by a boss.

3. An evaporative cooler pad assembly according to claim 1 wherein said pair of side grids are positioned and arranged to retain the pad from lateral displacement and said projections are positioned and arrange to retain said pad from vertical displacement.

* * * * *